United States Patent [19]

Oberhauser et al.

[11] Patent Number: 4,489,152

[45] Date of Patent: Dec. 18, 1984

[54] PHOTOGRAPHIC PRODUCT FOR SILVER TRANSFER IMAGES WITH POLYVINYLPYRROLIDONE IN CARBON BLACK LAYER

[75] Inventors: David F. Oberhauser, Somerville; Peter H. Roth, Needham, both of Mass.

[73] Assignee: Polaroid Corporation, Cambridge, Mass.

[21] Appl. No.: 584,597

[22] Filed: Feb. 29, 1984

[51] Int. Cl.[3] ..... G03C 1/84; G03C 5/54

[52] U.S. Cl. ..... 430/229; 430/517

[58] Field of Search ..... 430/229, 227, 517

[56] References Cited

U.S. PATENT DOCUMENTS

| | | | |
|---|---|---|---|
| 2,978,428 | 4/1961 | Abergee | 106/308 N |
| 3,594,165 | 7/1971 | Rogers | 430/220 |
| 3,595,652 | 7/1971 | Farney | 430/229 |
| 3,705,804 | 12/1972 | Farney et al. | 430/229 |
| 3,740,220 | 6/1973 | DeHaes et al. | 430/229 |
| 4,444,866 | 4/1984 | Sakai et al. | 430/517 |

*Primary Examiner*—Richard L. Schilling

*Attorney, Agent, or Firm*—Stanley H. Mervis

[57] ABSTRACT

Diffusion transfer film units and processes are disclosed wherein a silver transfer image is formed in an image layer separated from the silver halide emulsion by a layer containing carbon black. Inclusion of polyvinylpyrrolidone in the carbon black layer provides increased silver transfer density.

9 Claims, 1 Drawing Figure

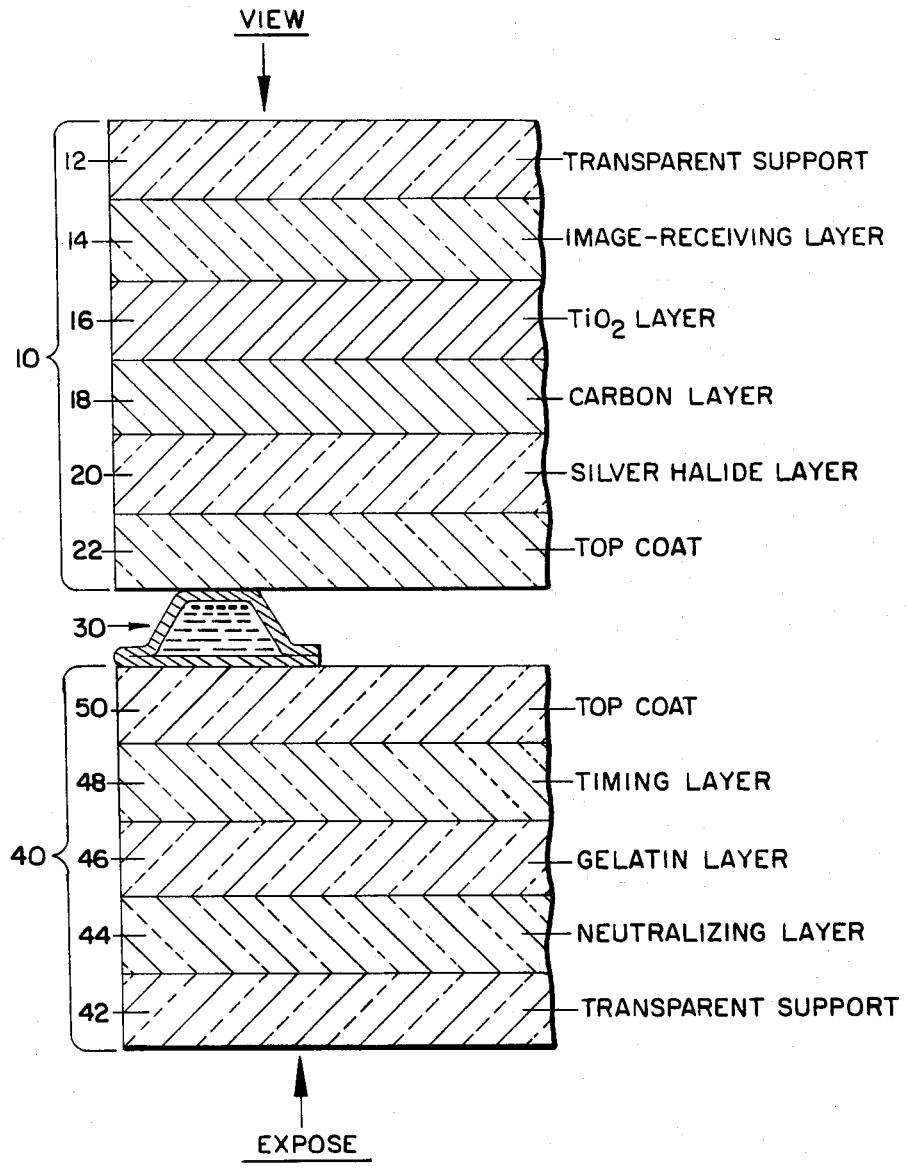
VIEW
12
14
16
10
18
20
22
TRANSPARENT SUPPORT
IMAGE-RECEIVING LAYER
$TiO_2$ LAYER
CARBON LAYER
SILVER HALIDE LAYER
TOP COAT
30
50
48
40
46
44
42
TOP COAT
TIMING LAYER
GELATIN LAYER
NEUTRALIZING LAYER
TRANSPARENT SUPPORT
EXPOSE

PHOTOGRAPHIC PRODUCT FOR SILVER TRANSFER IMAGES WITH POLYVINYLPYRROLIDONE IN CARBON BLACK LAYER

This invention is concerned with photography and, more particularly, with diffusion transfer film units and processes wherein a silver transfer reflection print is provided.

BACKGROUND OF THE INVENTION

Diffusion transfer photography is well known and has been commercially utilized to provide "instant" images in both color and black and white. Color films are available which provide reflection prints in a peel-apart format, e.g., Type 108 Polaroid Polacolor 2 color film, or in an integral format in which the image component remains bonded to the photosensitive component, e.g., Polaroid SX-70 Land film or Kodak PR-10 film.

Black and white transfer images are formed by the imagewise transfer of complexed silver from the undeveloped areas of the exposed silver halide emulsion to an image-receiving layer containing silver precipitating agents or nuclei. Films are commercially available which provide a silver transfer image in a peel-apart format, e.g., Type 107 Polaroid Land film, but as yet no integral black and white silver transfer film has been commercialized, although references to such a film may be found in the patent literature.

One of the problems encountered in formulating an integral silver transfer reflection print has been the need to provide an opaque layer, i.e., a layer of carbon black, between the silver halide emulsion layer and the image-receiving layer so that the film unit may be developed outside the camera. In addition, a light-reflecting layer, e.g., a white layer of titanium dioxide, is positioned between the carbon black layer and the image-receiving layer to provide a white background against which the silver transfer image may be viewed. The complexed silver has to diffuse from the silver halide emulsion layer through the layer of carbon black and the titanium dioxide layer to reach the image-receiving layer where the silver is precipitated to provide the desired image. For reasons not completely understood, the carbon black appears to prevent a significant portion of the diffusing silver complex from reaching the image-receiving layer. The resulting silver transfer image thus may exhibit an undesirably low maximum density. While the silver transfer density may be increased, for example, by coating more silver halide, this is an undesirable alternative because of the significant added cost. In addition, the additional silver halide may give rise to other sensitometric problems.

DETAILED DESCRIPTION OF THE INVENTION

Carbon black dispersions for use in coating opaque layers typically are prepared by milling or attriting carbon black in water in the presence of a dispersing agent to form a colloidal dispersion. Various dispersing agents are known for such use, and it is also known that such a dispersing agent may be omitted if the dispersion is sufficiently fine (e.g., by a longer attrition process) and sufficiently stable for coating purposes without such a dispersing agent. U.S. Pat. No. 2,978,428, issued Apr. 4, 1961 in the name of David C. Aberegg, describes the use of polyvinylpyrrolidone as an effective dispersing agent for carbon black.

SUMMARY OF THE INVENTION

It now has been found that silver transfer density when transfer is through a layer of carbon black may be increased by including polyvinylpyrrolidone in the layer of carbon black.

It has been found that when polyvinylpyrrolidone is present in the carbon black layer, the transfer of complexed silver through the layer of carbon black gives a higher silver density than when the polyvinylpyrrolidone is not present. This result was unexpected, since the presence of polyvinylpyrrolidone in the carbon black layer of an analogous color transfer film unit employing dye developers did not evidence any significant effect upon the sensitometry of the color film, i.e., the sensitometry was not adversely affected by omitting the polyvinylpyrrolidone from the carbon black dispersion.

In accordance with this invention, the polyvinylpyrrolidone is included in the carbon black layer in a concentration effective to provide increased silver transfer density. The polyvinylpyrrolidone preferably is added to a preformed dispersion of carbon black, although it also may be added prior to the attrition step. In general, it has been found that concentrations of about 2 to 10%, and more preferably about 2 to 5%, of the K-15 grade of polyvinylpyrrolidone (GAF Corp., New York, NY), by weight of carbon black, provide the beneficial effects. The K-15 grade is reported to have a number average molecular weight of about 10,000. Suitable polyvinylpyrrolidone concentrations may be determined by routine scoping tests, and may vary somewhat as a function of other component concentrations, e.g., the concentration and type of silver halide solvent.

The FIGURE illustrates, in exaggerated cross-sectional form, a film unit incorporating this invention. A photosensitive element 10 comprises a transparent support 12, an image-receiving layer 14, a light-reflecting layer 16 of titanium dioxide, an opaque layer 18 of carbon black, a photosensitive silver halide layer 20 and, optionally, a top coat 22. A second element 40, sometimes referred to as a spreader sheet, comprises a transparent support 42 carrying a neutralizing layer 44, a water-absorbing layer 46, preferably of gelatin, a timing layer 48 and, optionally, a top coat 50. A rupturable container or pod 30 is positioned so as to release the processing composition contained therein for distribution in a thin layer between the opposed surfaces of elements 20 and 40. The processing composition preferably is opaque, e.g., by the incorporation therein of carbon black.

In the preferred embodiment, elements 10 and 40 are secured in superposed relationship by a suitable binding mask, as is well known in the art and as illustrated, for example, in U.S. Pat. No. 3,594,165 issued July 20, 1971 to Howard G. Rogers to which reference may be made. Such a film unit may be ejected from a camera or camera back and developed in ambient light because the opaque layer 18 of carbon black and the light-reflecting layer 16 provide protection from further exposure from one side, and the layer of opaque processing composition provides such protection from the other side of the silver halide emulsion layer 20. As is well understood in the art, the opacity required by each of these opacifying layers will vary as a function of the ambient light level, the sensitivity or "speed" of the film, and the processing or development time for the particular film.

If desired, an anti-reflection coating may be provided on the outer surface of either or both of the transparent supports 12 and 42. Suitable anti-reflection coatings include those described in U.S. Pat. No. 3,793,022 issued Feb. 19, 1974 to Edwin H. Land, Stanley M. Bloom and Howard G. Rogers.

Spreader sheet support 42 has been illustrated as being transparent so that photoexposure may be effected through it. An alternative is to use an opaque support and to superpose the spreader sheet on the photosensitive element 10 after photoexposure has been effected, as described in U.S. Pat. No. 3,594,164 issued July 20, 1971 to Howard G. Rogers.

As will be recognized by those skilled in the art, the illustrated film unit does not require the use of a mirror in the exposure optical path in order to obtain a correctly oriented image in the image-receiving layer 14.

Suitable materials for neutralizing layer 44 are well known in the art. Preferred materials are polymeric acids, such as described in U.S. Pat. No. 3,362,819 issued Jan. 9, 1968 to Edwin H. Land to which reference may be made. A preferred polymeric acid is a partial butyl ester of poly(ethylene/maleic anhydride) copolymer. In general, it has been found desirable to have a final pH, as measured about a week after processing, of about 8 to 10. If the final pH is much lower, stability of the silver image may be adversely affected.

Optional top coats 22 and 50 may serve as anti-abrasion and/or as anti-blocking layers, and may comprise, for example, gelatin or polyvinyl alcohol. In certain preferred embodiments, the top coat may also include silica particles, e.g., silica particles about 3 microns in diameter.

The timing layer 48 provides a time delay for the permeation of water to the water-absorbing layer 46, as well as for alkali to reach the neutralizing layer 44. Delaying the permeation of water from the layer of processing fluid into the water-absorbing layer 46 assures availability in the photosensitive element in the early part of the process of the water necessary to effect development of the exposed silver halide emulsion and formation of the silver transfer image. Use of such a timing layer has been found to greatly reduce the incidence of mottle due to variations in the thickness of the applied layer of processing fluid. The thickness of the water-absorbing layer is selected according to the amount of processing fluid applied per unit area. A particularly useful polymer for the water-absorbing layer is gelatin, although other hydrophillic polymers may be used, e.g., polyvinyl alcohol. In the preferred embodiment, the water-absorbing layer comprises gelatin and includes an alkali-activated hardening agent, e.g., propylene glycol alginate; such a water absorbing layer allows rapid swelling and water absorption once the timing layer has been permeated, and a controlled hardening or cross-linking of the gelatin so that the resulting photograph becomes resistant to pressure deformation within a short time after the transfer image has been formed.

Suitable materials for use as the timing layer are known in the art, and illustrative materials are described in the above-referenced U.S. Pat. No. 3,362,819 and also in U.S. Pat. Nos. 3,419,839, 3,421,893, 3,455,686 and 3,575,701 as well as others.

The composition of silver precipitating layers also is well known and a variety of silver precipitating agents or nuclei may be used in a variety of matrix or binder materials. Particularly useful image-receiving layers comprise colloidal palladium dispersed in colloidal silica.

The processing fluid contains a film-forming polymer adapted to provide viscosity suitable for distributing the processing fluid in a thin layer of substantially uniform thickness between the superposed sheet-like elements of the film unit. A preferred polymer is high molecular weight hydroxyethyl cellulose, although other polymers such as sodium carboxymethyl cellulose also are suitable. The processing fluid typically includes an alkali, such as sodium or potassium hydroxide, a silver halide developing agent and one or more silver halide solvents, such as sodium thiosulfate, uracil, etc. Development restrainers, antifoggants and toning agents also may be included in the processing fluid and/or in one or more of the layers of the film unit.

Where it is desired to have the film unit exit the camera and be processed in ambient light, it is preferred to have the transparent support 42 contain a small quantity of carbon or other light-absorbing pigment to provide anti-light-piping properties to the transparent support, as disclosed in British No. 1,381,107 published Jan. 22, 1975. Such a pigment need not be included in transparent support 12 since layers 16 and 18 will prevent light which may be piped through transparent support 12 from exposing the silver halide emulsion layer 20.

The following example is given to illustrate the invention and is not intended to be limiting.

EXAMPLE

A control photosensitive element without polyvinyl pyrrolidone was prepared by coating the following layers on a 4 mil transparent polyethylene terephthalate film base:

1. an image-receiving layer comprising approximately 1.4 mg/m$^2$ of colloidal palladium, using a coating solution comprising approximately 60.13 g. of a colloidal silica dispersion (approximately 32% silica), 5.7 g. of a 60.6/29/6.3/3.7/0.4 latex copolymer of butylacrylate, diacetone acrylamide, styrene, methacrylic acid and acrylic acid, approximately 2.35 g. of 0.5 micron polytetrafluoroethylene beads, approximately 0.034 g. of 2-mercaptothiazoline, approximately 0.017 g. of 2,4-dithiouracil and approximately 4.55 g. of a gelatin dispersion of colloidal palladium nuclei (approximately 0.62% palladium), and approximately 875 g. of water;

2. a light-reflecting layer comprising approximately 1633 mg./m$^2$ of titanium dioxide, approximately 204 mg/m$^2$ of gelatin, approximately 570 mg/m$^2$ of glycerine and approximately 75 mg/m$^2$ of silica;

3. a light-reflecting layer comprising approximately 19,369 mg/m$^2$ of titanium dioxide, approximately 2420 mg/m$^2$ of gelatin, approximately 570 mg/m$^2$ of glycerine and approximately 894 mg/m$^2$ of silica;

4. an opaque layer comprising approximately 1500 mg/m$^2$ of carbon black, and approximately 409 mg/m$^2$ of inert gelatin;

5. a gelatino silver halide emulsion layer comprising approximately 1244 mg/m$^2$ of gelatin and a blend of approximately 284 mg/m$^2$ of silver as 1.0 micron 6% silver bromoiodide grains and 93 mg/m$^2$ of silver as 1.75 micron 6% silver bromoiodide grains (volume diameter), panchromatically sensitized; and 6. a top coat comprising approximately 1100 mg/m$^2$ of gelatin.

A spreader sheet was prepared by coating a 4 mil transparent polyethylene terephthalate film base with the following layers:

1. a neutralizing layer comprising approximately 8000 mg/m$^2$ of a mixture of 9 parts of a half butyl ester of poly(ethylene/maleic anhydride) copolymer and 1 part of polyvinyl butyral;

2. a water-absorbing layer comprising approximately 10,800 mg/m$^2$ of gelatin containing propylene glycol alginate at a concentration of about 3% by weight of gelatin and sorbitol at a concentration of about 20% by weight of gelatin;

3. a timing layer comprising approximately 3300 mg/m$^2$ of a mixture of a 60.6/29/6.3/3.7/0.4 latex copolymer of butyl acrylate, diacetone acrylamide, styrene, methacrylic acid and acrylic acid and polyvinyl alcohol at a concentration of approximately 5% by weight of the latex solids; and 4. a top coat comprising approximately 300 mg/m$^2$ of polyvinyl alcohol.

Test photosensitive elements as above also were prepared wherein polyvinylpyrrolidone was added to the opaque carbon black layer at the following levels (weight percent of carbon): Test 1: 2.5%, Test 2: 5% and Test 3: 10%.

The following processing fluids were prepared:

| | |
|---|---|
| Potassium hydroxide (45% solution) | 747.4 g. |
| N,N—dimethoxyethyl hydroxylamine | 74.87 g. |
| Titanium dioxide | 896.3 g. |
| Triethanolamine | 16.12 g. |
| Zinc acetate | 29.76 g. |
| Colloidal silica (30% solids) | 69.23 g. |
| Carbon black dispersion (30% carbon black) | 430.4 g. |
| Hydroxyethyl cellulose (high viscosity) | 119.1 g. |
| Water | 2,079 g. |

| | |
|---|---|
| Potassium hydroxide (45% solution) | 825.3 g. |
| N,N—dimethoxyethyl hydroxylamine | 59.93 g. |
| 2,3,6-trimethyl-4-aminophenol hydrochloride | 1.688 g. |
| Titanium dioxide | 567 g. |
| Triethanol amine | 16.13 g. |
| 6-benzylaminopurine | 4.082 g. |
| 2-methylthiomethyl-4,6-dihydroxypyrimidine | 163.4 g. |
| Zinc acetate | 29.77 g. |
| Potassium iodide | 0.7087 g. |
| Colloidal silica (30% solids) | 69.26 g. |
| Carbon black dispersion (30% carbon black) | 430.6 g. |
| Potassium thiosulfate | 19.99 g. |
| Hydroxyethyl cellulose (high viscosity) | 119.1 g. |
| Water | 2,036 g. |

| | |
|---|---|
| Potassium hydroxide (45% solution) | 747.4 g. |
| N,N—dimethoxyethyl hydroxylamine | 74.87 g. |
| 2,3,6-trimethyl-4-aminophenol hydrochloride | 1.687 g. |
| 2,4-dithiouracil | 0.929 g. |
| Titanium dioxide | 896.3 g. |
| Triethanolamine | 16.12 g. |
| 6-benzylamino-purine | 4.082 g. |
| 2-methylthiomethyl-4,6 dihydroxypyrimidine | 163.3 g. |
| Zinc acetate | 29.76 g. |
| Colloidal silica (30% solids) | 69.23 g. |
| Carbon black dispersion (30% carbon black) | 430.4 g. |
| 4-thiouracil | 1.417 g. |
| Potassium iodide | 1.419 g. |
| Hydroxyethyl cellulose (high viscosity) | 119.1 g. |
| Water | 2,079 g. |

-continued

| | |
|---|---|
| Potassium hydroxide (45% solids) | 747.4 g. |
| N,N—dimethoxyethyl hydroxylamine | 74.87 g. |
| 2,3,6-trimethyl-4-aminophenol hydrochloride | 1.687 g. |
| 2,4-dithiouracil | 0.927 g. |
| Titanium hydroxide | 896.3 g. |
| Triethanol amine | 16.12 g. |
| 6-benzylaminopurine | 4.082 g. |
| Sodium thiosulfate | 11.34 g. |
| 2-methylthiomethyl-4,6-dihydroxyprimidine | 163.3 g. |
| Zinc acetate | 29.76 g. |
| Colloidal silica (30% solids) | 69.23 g. |
| Carbon black dispersion (30% carbon black) | 430.4 g. |
| 4-thiouracil | 1.417 g. |
| Potassium iodide | 1.419 g. |
| Hydroxyethyl cellulose (high viscosity) | 119.1 g. |
| Water | 2,079 g. |

Reagent E

Reagent E was the same as Reagent B except that the 2,4-dithiouracil was omitted and 0.0709 g. of hexahydropyrimindine-2-thione and 0.1063 g. of thiazolidine-2-thione were added.

A series of each of the photosensitive elements were exposed at 0.25 meter candle seconds to a step wedge target and then superposed with the spreader sheet as a layer approximately 0.0024 inches thick of a processing fluid was spread between the superposed sheets. The silver transfer image was substantially completely formed in about 1 minute. After about 1 hour, the reflectance density of the image-receiving layer was measured through the transparent base. The densities obtained were:

| Reagent | $D_{max}$ | $D_{min}$ |
|---|---|---|
| Control (no polyvinylpyrrolidone) | | |
| B | 1.58 | 0.12 |
| C | 1.47 | 0.13 |
| D | 1.50 | 0.12 |
| E | 1.41 | 0.12 |
| Test 1 (2.5% polyvinylpyrrolidone) | | |
| B | 1.75 | 0.21 |
| C | 1.78 | 0.14 |
| D | 1.76 | 0.15 |
| E | 1.75 | 0.19 |
| Test 2 (5% polyvinylpyrrolidone) | | |
| B | 1.75 | 0.21 |
| C | 1.78 | 0.14 |
| D | 1.76 | 0.15 |
| E | 1.75 | 0.19 |
| Test 3 (10% polyvinylpyrrolidone) | | |
| B | 1.78 | 0.78 |
| C | 1.80 | 0.22 |
| D | 1.80 | 0.49 |
| E | 1.76 | 0.65 |

Reagent A contained no silver solvent. When this reagent ws used under the same conditions with the control photosensitive element which did not contain polyvinylpyrrolidone, no silver density was observed on the image-receiving layer. When this test was repeated using Reagent A and the Test 3 photosensitive element containing 10% polyvinylpyrrolidone, no silver density was observed on the image-receiving layer.

A comparison of the above silver transfer densities shows that the presence of polyvinylpyrrolidone resulted in increased silver transfer density.

The carbon black dispersions used in preparing the processing reagents did not include polyvinylpyrrolidone, as polyvinylpyrrolidone would not be stable at the high alkalinity of the processing reagent.

Film units as described in the above example and having an equivalent ASA rating of 200 have been ejected from a camera and processed in ambient light of about 250 foot candles without significant loss of density due to fog.

It will be understood by those skilled in the art that the various coating solutions may and preferably do include small amounts of surfactants. Where appropriate, a bacteriostat also may be present. Anti-static agents also may be provided.

What is claimed is:

1. A photographic product comprising a sheet-like element comprising a transparent support carrying, in sequence, an image-receiving layer containing silver precipitating nuclei, a white light-reflecting layer, an opaque layer comprising carbon black, and a photosensitive silver halide emulsion layer, said opaque layer also containing polyvinylpyrrolidone in a concentration, by weight of said carbon black, effective to increase the density of a silver transfer image formed in said image-receiving layer.

2. A photographic product as defined in claim 1 wherein said white light-reflecting layer comprises titanium dioxide.

3. A photographic product as defined in claim 1 wherein said concentration of polyvinylpyrrolidone is about 2 to 10%.

4. A photographic product as defined in claim 1 wherein said concentration of polyvinylpyrrolidone is about 2 to 5%.

5. A photographic product as defined in claim 1 wherein said concentration of polyvinylpyrrolidone is about 2.5%.

6. A photographic product as defined in claim 1 wherein said polyvinylpyrrolidone has a number average molecular weight of about 10,000.

7. A photographic product as defined in claim 1, including a second sheet-like element comprising a second support carrying, in sequence, a neutralizing layer, a water-absorbing layer, and a timing layer, said first and second sheet-like elements being adapted to be superposed with said supports being external and with a rupturable container releasably holding a processing fluid positioned therebetween.

8. A photographic product as defined in claim 7 wherein said second support is transparent and said first and second sheet-like elements are held together in said superposed relationship so that photoexposure of said silver halide emulsion is effected through said second sheet-like element.

9. A photographic product as defined in claim 8 wherein said processing composition contains carbon black.

* * * * *